United States Patent [19]

Tomisawa

[11] Patent Number: 4,875,456

[45] Date of Patent: Oct. 24, 1989

[54] SELF-DIAGNOSIS SYSTEM FOR AUXILIARY AIR CONTROL SYSTEM OF INTERNAL COMBUSTION ENGINE

[75] Inventor: Naoki Tomisawa, Gunma, Japan

[73] Assignee: Japan Electronic Control Systems Company Limited, Isezaki, Japan

[21] Appl. No.: 307,466

[22] Filed: Feb. 8, 1989

[51] Int. Cl.[4] ..... F02D 9/00; F02D 41/18

[52] U.S. Cl. ..... 123/585; 123/339

[58] Field of Search ..... 123/585, 339, 494; 364/431.11; 73/118.2, 118.1

[56] References Cited

U.S. PATENT DOCUMENTS

| | | | |
|---|---|---|---|
| 4,557,234 | 12/1985 | Ito | 123/339 |
| 4,601,199 | 7/1986 | Denz | 73/118.1 |
| 4,780,826 | 10/1988 | Nakano et al. | 364/431.11 |
| 4,787,351 | 11/1988 | Sakamoto et al. | 123/339 |
| 4,796,588 | 1/1989 | Shimomura et al. | 73/118.2 |
| 4,817,418 | 4/1989 | Asami et al. | 73/118.1 |

FOREIGN PATENT DOCUMENTS

| | | | |
|---|---|---|---|
| 0143362 | 6/1988 | Japan | 123/585 |

*Primary Examiner*—Willis R. Wolfe
*Assistant Examiner*—M. Macy
*Attorney, Agent, or Firm*—Foley & Lardner, Schwartz, Jeffery, Schwaab, Mack, Blumenthal & Evans

[57] ABSTRACT

A self-diagnosis system for an auxiliary air control system of an internal combustion engine having an auxiliary air control valve provided in an auxiliary air passage bypassing a main throttle valve, comprises an air flow meter for detecting the amount of intake air, a control unit diagnosing malfunction of the air flow meter and comparing the amount of air inducted when the main throttle valve is fully closed with a value calculated according to the opening angle of the auxiliary air intake control valve. The control unit deems that the auxiliary air control system has malfunctioned only when the amount of intake air is larger than the calculated valve. In the device according to the invention, the malfunction of auxiliary air control system can be detected within a relatively short time, such as 1 sec, and the malfunction can be detected regardless of the engine speed.

20 Claims, 2 Drawing Sheets

SELF-DIAGNOSIS SYSTEM FOR AUXILIARY AIR CONTROL SYSTEM OF INTERNAL COMBUSTION ENGINE

BACKGROUND OF THE INVENTION

1. Field of the Invention

The present invention relates generally to a self-diagnosis system for an auxiliary air control system of an internal combustion engine. More specifically, the invention relates to a self-diagnosis system for rapidly detecting malfunction of an auxiliary air control system.

2. Description of the Background Art

When a throttle valve of an internal combustion engine of automotive vehicles is closed or slightly opened, only a restricted small amount of air can pass through the main air intake passage. The air speed is low, and therefore very little vacuum is developed in the venturi. Therefore, an air intake system for an internal combustion engine of automobiles, has an auxiliary air control system including an auxiliary air passage bypassing the throttle valve in addition to the main air intake passage comprising the venturi. The auxiliary air passage includes an auxiliary air control valve provided therein to control the amount of air passed therethrough by adjusting opening angle of the control valve. This allows the idling speed of the engine to be controlled.

One such system, called an idle system, has been disclosed in the Japanese Utility Model Publication No. (Jikkai Showa) 60-15942.

Generally, a vehicle having an automatic transmission will cause substantial creep if the amount of air flow passing through the auxiliary air passage is suddenly increased due to malfunction in the auxiliary air control system, and as a result the idling speed is abnormally increased.

Therefore, self-diagnosis systems have been proposed for controlling the auxiliary air control system so as to prevent the vehicle from creeping due to malfunction of the auxiliary air control system.

The prior self-diagnosis system detects malfunction of the auxiliary air control system by comparing a target idling speed $N_{SET}$ with an actual idling speed N. If $N > N_{SET} + 500$ rpm for a predetermined time, such as, for example 10 sec, a command signal for full closure of the auxiliary air control valve, is generated upon detection of malfunction thereby preventing the creep of the vehicle.

However, the prior self-diagnosis system, wherein self-diagnosis is performed by comparing the target idling speed with the actual idling speed, tends to erroneously assume abnormality in the auxiliary air control system when the vehicle is coasting with the throttle closed. This system has a further disadvantage in that it requires the aforementioned predetermined judgement time for detecting malfunction of the control system. This judgement time is relatively long.

In order to overcome the problems in the prior systems and increase the performance of the self-diagnosis systems, there has been proposed an improved self-diagnosis system which reliably detects malfunction of the auxiliary air control system within a relatively short time from just after the occurrence of malfunction until the decision of malfunction.

SUMMARY OF THE INVENTION

Therefore, it is a principle object of the present invention to provide a self-diagnosis system, in which malfunction of an auxiliary air control system is detected within a short judgement time, by detecting malfunction of the auxiliary air control system on the basis of the amount of air passing through a main air intake passage and an auxiliary air passage. The self-diagnosis system of the invention reliably functions as a fail-safe device for preventing unanticipated sudden creep of the vehicle.

In order to accomplish the aforementioned and other objects, a self-diagnosis system for an auxiliary air control system of an internal combustion engine having an auxiliary air control valve, provided in an auxiliary air passage which bypasses a throttle valve of an air intake system of the engine, comprises first means for detecting the amount of air inducted through a main air intake passage of the engine, second means comparing the amount of air detected by the first means under the condition of fully closed throttle valve with a value calculated according to the auxiliary valve's opening angle control command signal, the second means judging that the auxiliary air control system is malfunctioning if the intake air amount detected by the first means is larger than the calculated value, third means for diagnosing malfunction of the first means, and the second means starting comparison between the intake air amount and the calculated value when the third means judges that the first means is operating normally. Preferably, the first means comprises an air flow meter or an intake air pressure sensor and the second and third means comprises a microcomputer. The microcomputer includes a counter by which judgement time for detecting malfunction of the auxiliary air control system is set. In the self-diagnosis system of the invention, the judgement time is 1 sec or less.

A method for self-diagnosing malfunction of an auxiliary air control system for an internal combustion engine having an auxiliary air control valve, provided in an auxiliary air passage which bypasses a throttle valve of an air intake system of the engine, for controlling the amount of air inducted through the auxiliary air passage, according to the invention comprises the steps of (a) judging the opening angle of the throttle valve, (b) judging the operational condition of first means for detecting the amount of air inducted through the main air intake passage of the engine, (c) judging the operational condition of a starter switch, (d) judging the rotational speed of the engine, (e) comparing the actual battery voltage with a predetermined voltage value, (f) deriving the amount of air inducted through the auxiliary air passage when the throttle valve is fully closed, the first means is operating normally, the starter switch is OFF, the engine is in operation, and the battery voltage is larger than the predetermined voltage value, (g) comparing a value calculated on the basis of the auxiliary air control valve control signal with the amount of air inducted through said main air intake passage of the engine, (h) incrementing a count value of a counter when the amount of air inducted through the main air intake passage is larger than the calculated value for the auxiliary air passage, (i) comparing the count value with a predetermined count value, and (j) judging that the auxiliary air control system has malfunctioned if the count value accumulated by repeating the sequential process of steps (a) to (i) is larger than the predetermined count value. The step (a) of judging the opening angle of the main throttle valve comprises comparing the actual opening angle with opening angle O. The step (b) of judging the operational condition of the first means is executed on the basis of an output voltage from the first means. The step (d) of judging the rotational speed of the engine is executed in accordance with a signal from an engine speed sensor. The amount of air inducted through the auxiliary air passage is derived from a duty factor of the control signal indicative of the opening angle of the auxiliary air control valve. Furthermore, the amount of auxiliary air is determined in consideration of atmospheric pressure, humidity of intake air, and leak loss from the throttle valve. The predetermined count value defines judgement time from just after the occurrence of malfunction until the determination of malfunction. The judgement time corresponding to the predetermined count value is set at 1 sec or less. The method for self-diagnosing an auxiliary air control system further comprises the steps of (k) outputting a command signal for fully closing the auxiliary air control valve, and/or (l) outputting a command signal for cutting fuel provided to the engine.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
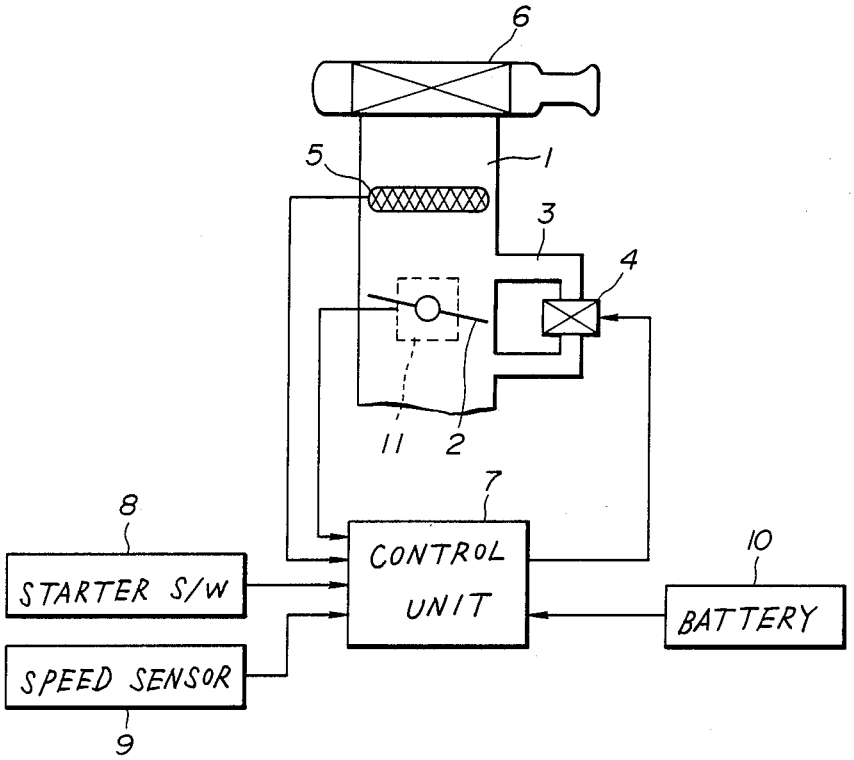
FIG. 1 is a schematic diagram illustrating a self-diagnosis system of the disclosed embodiment of the present invention.

Referring now to the drawings, particularly to FIG. 1, an auxiliary air passage 3 is formed on an air intake passage 1 of an internal combustion engine. The auxiliary air passage bypasses throttle valve 2. The auxiliary air passage includes an auxiliary air control valve 4 whose opening angle is controlled in accordance with a control signal from a control unit 7. Upstream of the throttle valve 2, an air flow meter 5 is provided in the air intake passage 1. The air flow meter 5 functions as an air flow detecting means by which the amount of air introduced through an air cleaner 6 into the air intake passage 1 is monitored. In the shown embodiment, a hot wire type air flow meter is used as the air detecting means.

The control unit 7 is comprised of a microcomputer which receives signals outputted from the air flow meter 5, a starter switch 8, an engine speed sensor for detecting engine speed, a battery 10, and an idle switch 11 which becomes ON when the throttle valve 2 is fully closed during idling. The control unit 7 judges whether the auxiliary air control system is operating normally or abnormally on the basis of the signals from the above elements and the control signal from the control unit 7 to the auxiliary air control valve 4. This process is started upon occurence of abnormality of the air flow meter 5. Therefore, the control unit 7 serves as a detection means for detecting malfunction of the air flow meter 5 and as a malfunction detection means for detecting malfunction of the auxiliary air control system.

Figure 2:
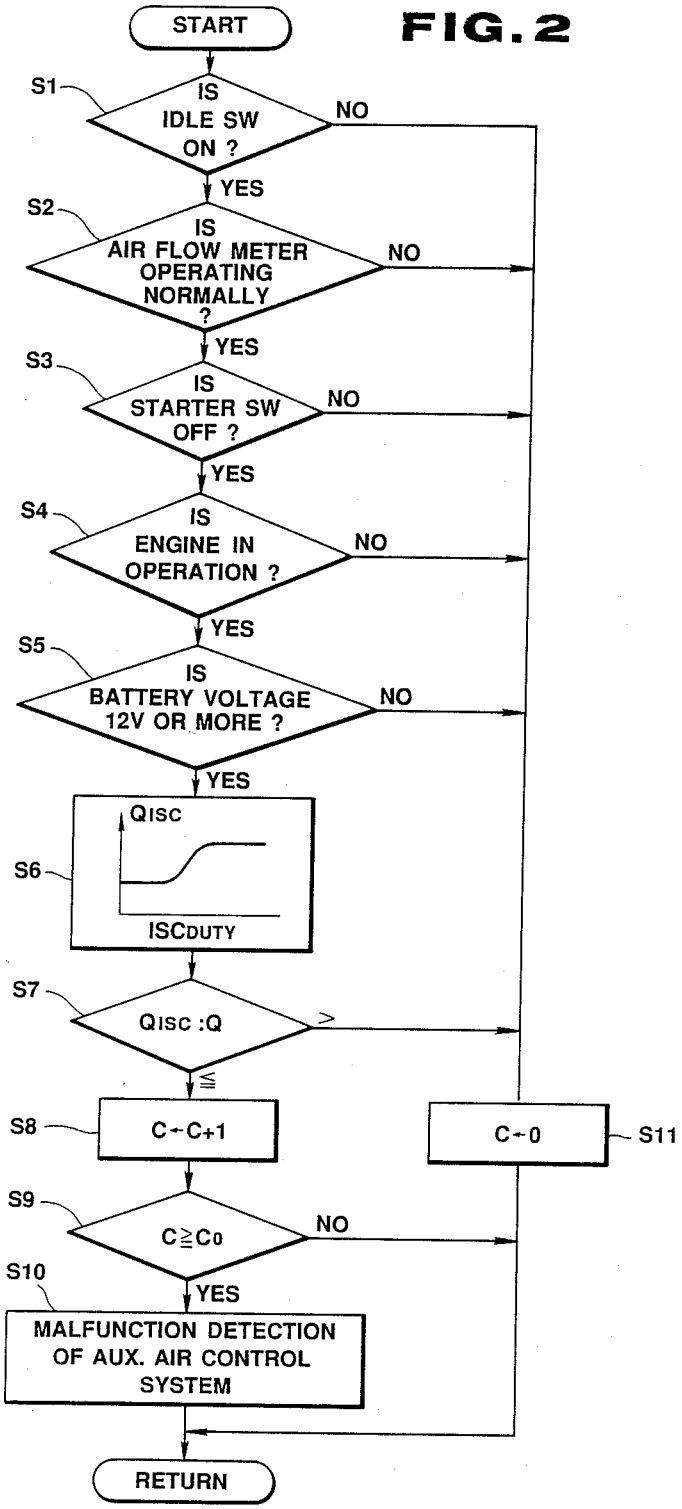
FIG. 2 is a flow chart showing the processing steps by which malfunction of an auxiliary air control system for an internal combustion engine is detected.

The operation of the self-diagnosis system of the embodiment will be described in detail in accordance with the procedure shown in FIG. 2. Step 1 to step 11 will be hereinafter described as S 1 to S 11. The program proceeds as follows:

S 1; Is the idle switch 11 ON?

S 2; Is the air flow meter 5 is operating normally?

The self-diagnosis of the air flow meter 5 is performed in accordance with the output voltage of the air flow meter 5. Usually, the air flow meter has an operating voltage 5 V and generates an output voltage of 1 V to 4 V. Therefore, when the value of the output voltage is within the range of 1 V≦4 V, the air flow meter is judged normal and when the value of the output voltage is less and 1 V or exceeds 4 V, the air flow meter is judged abnormal by the control unit 7. The program continues:

S 3; Is the starter switch 8 OFF ?

S 4; Is the engine in operation ?

S 5; Is the battery 10 more than a predetermined voltage, such as 12 V?

S 6; If all these conditions are satisfied, the amount of auxiliary air ($Q_{ISC}$) passed through the auxiliary air control valve 4, is derived on the basis of the control signal outputted from the control unit 7 to the auxiliary air control valve 4.

The amount of auxiliary air is derived on the basis of a graph illustrating the relationship between the duty factor ($ISC_{DUTY}$) of the control signal and the estimated amount of air $Q_{ISC}$. In practice, the value $Q_{ISC}$ relative to the duty factor of the control signal fluctuates. Therefore, in the embodiment, the amount $Q_{ISC}$ is determined by adding a first value representing change in atmospheric pressure and change in humidity of intake air, a second value corresponding to the maximum value of leakage loss of the throttle body, and a third value corresponding to air leakage from the throttle valve while the idle switch is ON, to the maximum value of $Q_{ISC}$ relative to the duty factor.

In Step 7, the amount $Q_{ISC}$ determined at Step 6 is compared with the amount of intake air (Q);

In Step 8, if $Q_{ISC} \leqq Q$, a count value C of a counter provided in the control unit 7 is incremented;

In Step 9, the control unit 7 makes a judgement to determine whether the count value C is larger than a predetermined set count value $C_o$;

In Step 10, if $C \geqq C_o$, the control unit 7 judges that the auxiliary air control system has malfunctioned; and In Step 11, if one of the conditions at any Steps 1 to 5 is not satisfied or $Q_{ISC} > Q$ at Step 7, the count value C is cleared.

As set forth above, according to the self-diagnosis system of the embodiment, when the air flow meter is normal, the throttle valve is fully closed during idling, the starter switch is OFF, the engine is in operation, and the battery voltage is larger than 12 V, all these conditions are satisfied, the intake air amount Q detected by the air flow meter is compared with the air flow $Q_{ISC}$. Thereafter, if a condition where $Q_{ISC} \leqq Q$ occures for a predetermined time, such as, for example 1 sec, corresponding to the predetermined count value of the counter, the self-diagnosis system judges that malfunction of the auxiliary air control system has occurred.

Figure 3:
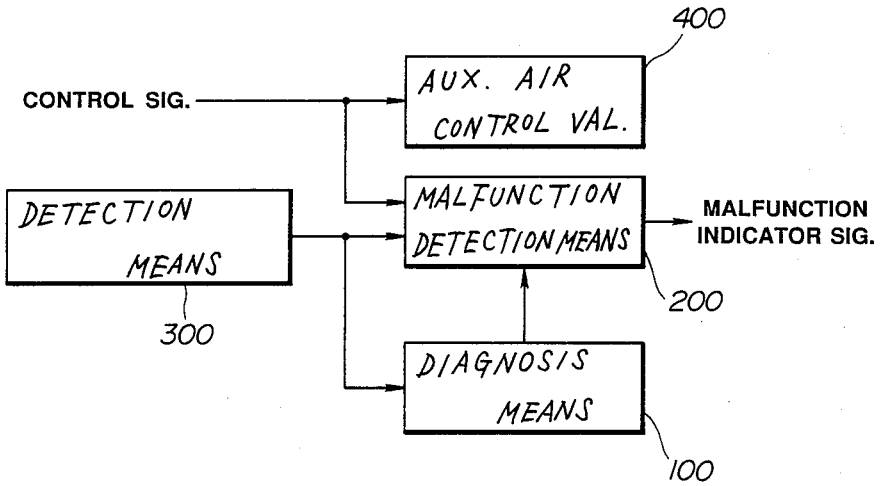
FIG. 3 is a block diagram showing the self-diagnosis system for the auxiliary air control system according to the invention.

As shown in FIG. 3, the self-diagnosis system of the invention operates as follows:

A diagnosis means 100 judges whether a detection means 300 detecting the amount of intake air is normal or abnormal;

Next, if the diagnosis means 100 decides that the detection means 300 operates normally, a malfunction detection means 200 compares the amount of intake air introduced into the air intake passage with the amount of auxiliary air introduced into the auxiliary air passage through an auxiliary air control valve 400, whose opening angle is set according to a control signal from the control unit; and If the amount of air inducted through the main intake is larger than that through the auxiliary air intake, the malfunction detection means 200 outputs a malfunction signal indicating malfunction of the auxiliary air control system.

As will be appreciated form the above, since the self-diagnosis system of the invention achieves the self-diagnosis of the auxiliary air control system on the basis of the amount of intake air introduced into the combustion engine and the estimated amount of auxiliary air introduced into the auxiliary air control system, the judgement time of the self-diagnosis system of the present invention, is shorter than that of prior self-diagnosis systems in which the self-diagnosis is performed on the basis of the engine speed.

Accordingly, the self-diagnosis system of the present invention can reliably avoid abnormal driving of the vehicle due to malfunction of the auxiliary air control system. Furthermore, the self-diagnosis system of the invention reacts quickly to prevent creeping of the vehicle.

If the self-diagnosis system detects malfunction of the auxiliary air control system, thereafter the control unit outputs a malfunction indicator signal to a valve driving device, such as an actuator with the result that the auxiliary air control valve is fully closed. Moreover, if the engine speed exceeds the predetermined target engine speed, the fuel may be cut in accordance with the malfunction detection signal from the control unit. In this manner, the self-diagnosis system of the invention functions as a fail-safe device.

As set forth above, since the self-diagnosis system of the invention diagnoses malfunction of the auxiliary air control system on the basis of the amount of intake air and the calculated auxiliary air value regardless of the engine speed, the self-diagnosis system never erroneously judges malfunction of the auxiliary air control system when the vehicle is coasting with the throttle closed.

Although in the above disclosed embodiment an air flow meter is used for detecting the amount of intake air, an intake air pressure sensor in which the amount of intake air is detected on the basis of negative pressure, for example, may be substituted for the hot wire air flow meter.

Although this invention has been shown and described with respect to detailed embodiment thereof, it will be understood by those skilled in the art that various changes in form and detail thereof may be made without departure from the spirit and scope of the claimed invention.

What is claimed is:

1. A self-diagnosis system for an auxiliary air control system of an internal combustion engine having an auxiliary air control valve, provided in an auxiliary air passage which bypasses a throttle valve of an air intake system of said engine, for controlling the amount of air inducted through said auxiliary air passage, comprising:

first means for detecting the amount of air inducted through a main air intake passage of said engine;

second means comparing the amount of air detected by said first means while said throttle valve is fully closed with a value calculated according to the opening angle command signal for said auxiliary air control valve, said second means judging that said auxiliary air control system is malfunctioning if said intake air amount detected by said first means is larger than said calculated value.

2. A self-diagnosis system as set forth in claim 1, wherein said first means comprises an air flow meter or an intake air pressure sensor.

3. A self-diagnosis system as set forth in claim 1, wherein said second means comprises a microcomputer.

4. A self-diagnosis system as set forth in claim 3, wherein said microcomputer includes a counter by which a judgement time for detecting malfunction of said auxiliary air control system is set.

5. A self-diagnosis system as set forth in claim 4, wherein said judgement time is 1 sec or less.

6. A self-diagnosis system for an auxiliary air control system of an internal combustion engine having an auxiliary air control valve, provided in an auxiliary air passage which bypasses a throttle valve of an air intake system of said engine, for controlling the amount of air inducted through said auxiliary air passage, comprising:

first means for detecting the amount of air inducted through a main air intake passage of said engine;

second means comparing the amount of air detected by said first means while said throttle valve is fully closed with a value calculated according to the opening angle command signal for said auxiliary air control valve, said second means judging that said auxiliary air control system is malfunctioning if said intake air amount detected by said first means is larger than said calculated value;

third means for diagnosing malfunction of said first means, said third means outputting a signal indicative of the operational condition of said first means; and said second means starting comparison between said intake air amount and said calculated value when said third means judges that said first means is operating normally.

7. A self-diagnosis system as set forth in claim 6, wherein said first means comprises an air flow meter or an intake air pressure sensor.

8. A self-diagnosis system as set forth in claim 6, wherein said second and third means comprise a microcomputer.

9. A self-diagnosis system as set forth in claim 8, wherein said microcomputer includes a counter by which a judgement time for detecting malfunction of said auxiliary air control system is set.

10. A self-diagnosis system as set forth in claim 9, wherein said judgement time is 1 sec or less.

11. A method for self-diagnosing malfunction of an auxiliary air control system for an internal combustion engine having an auxiliary air control valve, provided in an auxiliary air passage which bypasses a throttle valve of an air intake system of the engine, for controlling the amount of air inducted through said auxiliary air passage, comprising steps of:

(a) judging the opening angle of said throttle valve;

(b) judging the operational condition of first means for detecting the amount of air inducted through a main air intake passage of said engine;
(c) judging the operational condition of a starter switch;
(d) judging the rotational speed of said engine;
(e) comparing an actual battery voltage with a predetermined voltage value;
(f) deriving the amount of air inducted through said auxiliary air passage when said throttle valve is fully closed, said first means is operating normally, said starter switch is OFF, said engine is in operation, and said battery voltage is larger than said predetermined voltage value;
(g) comparing a calculated value of auxiliary air passage induction with the amount of air inducted through said main air intake passage of said engine;
(h) incrementing a counter when the amount of air inducted through said main air intake passage is larger than said calculated value for auxiliary air passage;
(i) comparing said count value with a predetermined count value; and
(j) judging that said auxiliary air control system has malfunctioned if said count value accumulated by repeating the sequential process of steps (a) to (i) is larger than said predetermined count value.

12. A method for self-diagnosing malfunction of an auxiliary air control system as defined by claim 11, wherein said step of judging the opening angle of said throttle valve comprises comparing the actual opening angle with opening angle O.

13. A method for self-diagnosing malfunction of an auxiliary air control system as defined by claim 11, wherein said step of judging the operational condition of said first means is executed on the basis of an output voltage from said first means.

14. A method for self-diagnosing malfunction of an auxiliary air control system as defined by claim 11, wherein said step of judging the rotational speed of said engine is executed in accordance with a signal from an engine speed sensor.

15. A method for self-diagnosing malfunction of an auxiliary air control system as defined by claim 11, wherein said amount of air inducted through said auxiliary air passage is derived from a duty factor of a control signal indicative of the opening angle of said auxiliary air control valve.

16. A method for self-diagnosing malfunction of an auxiliary air control system as defined by claim 15, wherein said amount of auxiliary air is determined in consideration of atmospheric pressure, humidity of intake air, and leak loss from said throttle valve.

17. A method for self-diagnosing malfunction of an auxiliary air control system as defined by claim 11, wherein said amount of intake air is detected by an air flow meter or an intake air pressure sensor.

18. A method for self-diagnosing malfunction of an auxiliary air control system as defined by claim 11, wherein said predetermined count value defines a judgement time beginning just after the occurrence of malfunction and ending when said predetermined count value is reached.

19. A method for self-diagnosing malfunction of an auxiliary air control system as defined in claim 18, wherein said judgement time is set at 1 sec or less.

20. A method for self-diagnosing malfunction of an auxiliary air control system as defined in claim 11, which further comprises steps of:
(k) outputting a command signal for fully closing of said auxiliary air control valve; and/or
(l) outputting a command signal for cutting fuel provided to said engine.

* * * * *